US005509874A

United States Patent [19]

Shih

[11] Patent Number: 5,509,874

[45] Date of Patent: Apr. 23, 1996

[54] STILT ASSEMBLY HAVING ADJUSTABLE MECHANISM

[76] Inventor: Ming-Tsu Shih, No. 60, Chen Pin Road, Tai Pin Cheng Taichung, Taiwan

[21] Appl. No.: 410,511

[22] Filed: Mar. 24, 1995

[51] Int. Cl.[6] ..... A63B 25/00

[52] U.S. Cl. ..... 482/75; 182/230

[58] Field of Search ..... 482/75, 76, 148, 482/66, 51; 135/68, 65, 69; 182/108, 204, 205, 230

[56] References Cited

U.S. PATENT DOCUMENTS 2,057,013 10/1936 Curtis ..... 482/75

3,933,222 1/1976 Craig, Jr. ..... 182/204

4,032,140 6/1977 Davis et al. ..... 482/76

4,415,063 11/1983 Hutchison ..... 182/230

*Primary Examiner*—Stephen R. Crow

*Attorney, Agent, or Firm*—Charles E. Baxley

[57] ABSTRACT

A stilt includes a tube having a number of holes, and a sleeve is slidably engaged on the tube. The sleeve includes an orifice and a depression formed in a wall member for slidably receiving a catch and a spring. A lever is pivotally coupled to the sleeve and has one end engaged with the catch for moving the catch. A foot support is pivotally coupled to the sleeve. The spring biases the lever in order to engage the catch with either of the holes of the tube such that the sleeve may be adjusted along the tube when the catch is disengaged from the tube.

1 Claim, 3 Drawing Sheets

STILT ASSEMBLY HAVING ADJUSTABLE MECHANISM

BACKGROUND OF THE INVENTION

1. Field of the Invention

The present invention relates to a stilt, and more particularly to a stilt assembly having an adjustable mechanism.

2. Description of the Prior Art

Typical stilts comprise a pair of posts each having a foot support solidly secured thereto for supporting the feet of the users. However, the foot supports are solidly secured to the post and may not be adjusted relative to the post.

The present invention has arisen to mitigate and/or obviate the afore-described disadvantages of the conventional stilts.

SUMMARY OF THE INVENTION

The primary objective of the present invention is to provide a stilt assembly having an adjustable mechanism for adjusting the foot supports relative to the posts.

In accordance with one aspect of the invention, there is provided a stilt assembly comprising at least one tube including a plurality of holes formed therein, a sleeve including an opening formed therein for slidably engaging on the tube, the sleeve including a wall member having an orifice and a depression formed therein and having a recess formed therein and communicating with the orifice and the depression, a catch slidably engaging in the orifice of the sleeve, a lever including a middle portion pivotally supported in the recess at a pivot pin and including a first end for engaging with the catch and including a second end, the first end being caused to rotate about the pivot pin in order to move the catch when the second end of the lever is rotated about the pivot pin, means for biasing the second end of the lever away from the sleeve, and a foot support including a first end pivotally coupled to the sleeve distal to the wall member and including a downward extending stop for engaging with the sleeve. The catch is engaged with either of the holes of the tube when the second end of the lever is biased away from the sleeve by the biasing means. The sleeve may be adjusted along the tube when the catch is disengaged from the tube and when the second end of the lever is depressed against the biasing means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
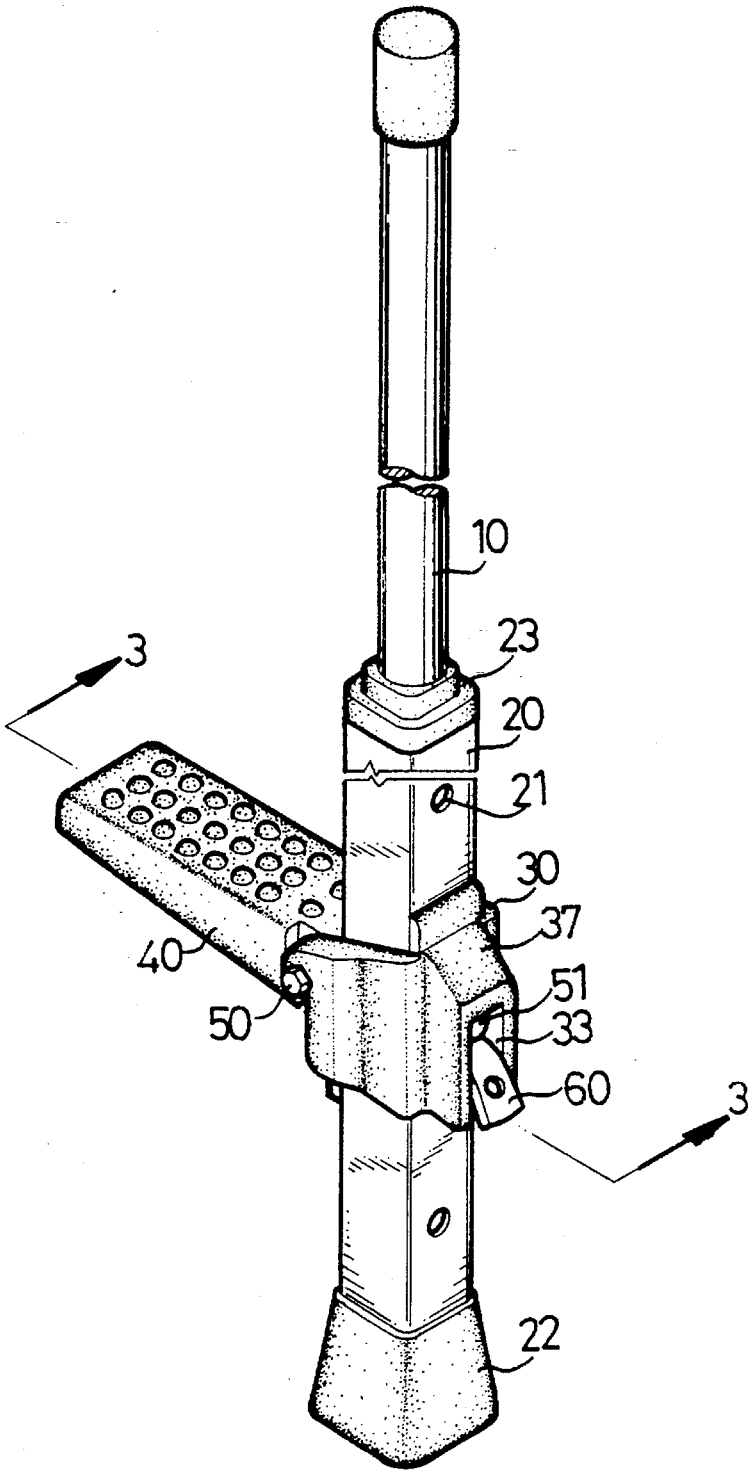
FIG. 1 is a perspective view of a stilt assembly in accordance with the present invention.
Figure 2:
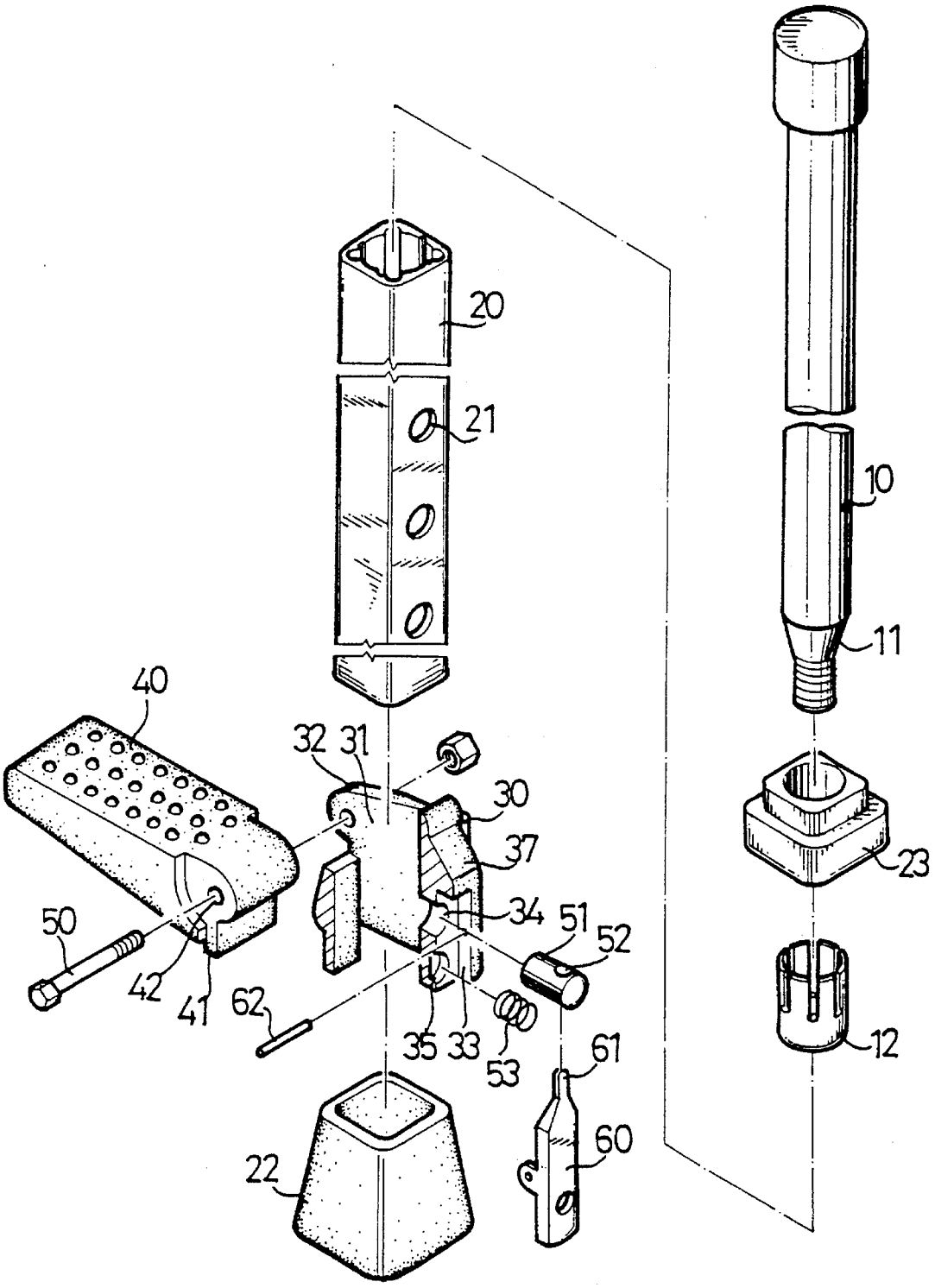
FIG. 2 is an exploded view of the stilt.

Referring to the drawings, a stilt assembly in accordance with the present invention comprises a tube 20 including a number of holes 21 formed therein and including a base 22 provided in the bottom portion and a cap 23 provided in the upper portion thereof. A rod 10 includes a lower portion extended through the cap 23 and extended inwards of the tube 20. The lower portion of the rod 10 includes a frustum shaped configuration 11 for engaging with a cylindrical member 12 which may secure the rod 10 to the tube 20. The configuration of the cylindrical member 12 and the rod 10 is not related to the present invention and will not be described in further details.

A sleeve 30 includes an opening 31 for slidably engaging on the tube 20 and includes a wall member 37 having an orifice 34 and a depression 35 formed therein and, having a recess 33 formed therein and communicating with the orifice 34 and the depression 35. A catch 51 is slidably engaged in the orifice 34 and includes an aperture 52 formed therein. A spring 53 has one end engaged in the depression 35. A lever 60 includes a middle portion pivotally engaged in the recess 33 by a pivot pin 62 and includes one end 61 engaged in the aperture 52 of the catch 51 so as to slidably move the catch 51 in the orifice 34 when the lever 60 is rotated about the pivot pin 62. The spring 53 is engaged with the other end of the lever 60 for biasing the other end of the lever 60 outward of the sleeve 30 such that the lever 60 may be rotated by depressing the other end thereof.

The sleeve 30 includes a bolt 50 pivotally engaged in a pair of flanges 32 which are provided opposite to the wall member 37 and extended away from the wall member 37. A foot support 40 includes a hole 42 formed in one end for pivotally engaging with the bolt 50 and includes a downward extending stop 41 for engaging with the sleeve 30 so as to maintain the foot support 40 in a substantially horizontal position, best shown in FIG. 3.

Figure 3:
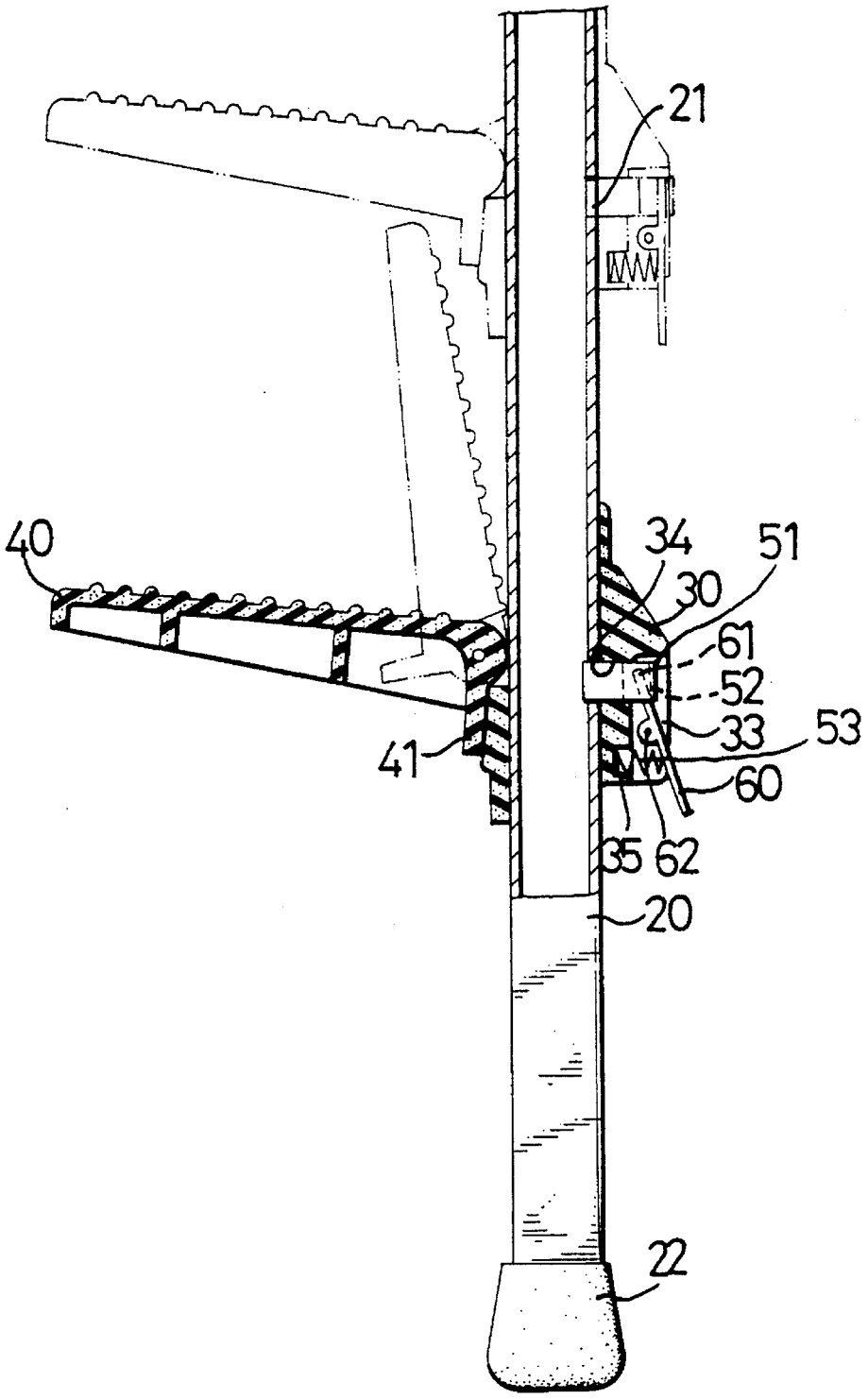
FIG. 3 is a cross sectional view taken along lines 3—3 of FIG. 1.

In operation, as shown in FIG. 3, the lever 60 is biased by the spring 53 so as to engage the catch with either of the holes 21 of the tube 20. The catch 51 may be disengaged from the tube 20 when the other end of the lever 60 is depressed against the spring 53 such that the sleeve 30 may be moved along the tube 20. The spring 53 may bias the catch 51 to engage with other holes 21 when the catch 51 is aligned with the holes 21 and when the lever 60 is released. The foot support 40 may be rotated about the bolt 50 to the position as shown in dotted lines where the foot support 40 is arranged in parallel to the tube 20 and is contacted with the tube 20 such that the foot support 40 may be folded to a compact configuration for storing and for transportation purposes.

Accordingly, the stilt assembly in accordance with the present invention includes a foot support that may be adjusted relative to the tube such that the stilt assembly may be used for various kinds of persons.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stilt assembly comprising:

at least one tube including a plurality of holes formed therein, a sleeve including an opening formed therein for slidably engaging on said tube, said sleeve including a wall member having an orifice formed therein and having a recess formed therein and communicating with said orifice, a catch slidably engaging in said orifice of said sleeve, a lever including a middle portion pivotally supported in said recess at a pivot pin and including a first end for engaging with said catch and including a second end, said first end being caused to rotate about said pivot pin in order to move said catch when said second end of said lever is rotated about said pivot pin, means for biasing said second end of said lever away from said sleeve, and a foot support including a first end pivotally coupled to said sleeve distal to said wall member and including a downward extending stop for engaging with said sleeve, said catch being engaged with either of said holes of said tube when said second end of said lever is biased away from said sleeve by said biasing means.

* * * * *